US008146482B2

(12) United States Patent
Hwang

(10) Patent No.: US 8,146,482 B2
(45) Date of Patent: Apr. 3, 2012

(54) HYDRAULIC CIRCUIT HAVING HOLDING VALVE OF EXTERNAL PILOT PRESSURE OPERATION TYPE

(75) Inventor: Tae In Hwang, Busan (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 492 days.

(21) Appl. No.: 12/274,498

(22) Filed: Nov. 20, 2008

(65) Prior Publication Data

US 2009/0145123 A1 Jun. 11, 2009

(30) Foreign Application Priority Data

Dec. 10, 2007 (KR) ..... 10-2007-0127657

(51) Int. Cl.
*F15B 13/04* (2006.01)

(52) U.S. Cl. ..... 91/445

(58) Field of Classification Search ..... 91/420, 91/445

See application file for complete search history.

(56) References Cited

U.S. PATENT DOCUMENTS

| | | | | |
|---|---|---|---|---|
| 6,282,893 | B1 * | 9/2001 | Porter et al. | 60/477 |
| 7,197,872 | B2 * | 4/2007 | Satake et al. | 91/445 |
| 2006/0163508 | A1 * | 7/2006 | Satake et al. | 251/100 |

* cited by examiner

*Primary Examiner* — Michael Leslie
(74) *Attorney, Agent, or Firm* — Ladas & Parry LLP

(57) ABSTRACT

A hydraulic circuit having a holding valve of an external pilot pressure operation type is provided, which can make a double check valve, which is installed to prevent an actuator from being pushed due to leakage of hydraulic fluid of a main control valve, be opened by an external signal pressure being supplied to shift the main control valve. The hydraulic circuit includes a double check valve installed in a flow path between the main control valve and the hydraulic cylinder to be opened by the pilot signal pressure for shifting the main control valve, and preventing the hydraulic cylinder from being moved due to leakage of hydraulic fluid of the main control valve, and a select valve shifted to open the double check valve in response to the pilot signal pressure being supplied in accordance with the manipulation of the joystick.

4 Claims, 3 Drawing Sheets

HYDRAULIC CIRCUIT HAVING HOLDING VALVE OF EXTERNAL PILOT PRESSURE OPERATION TYPE

CROSS-REFERENCE TO RELATED APPLICATION

This application is based on and claims priority from Korean Patent Application No. 10-2007-0127657, filed on Dec. 10, 2007 in the Korean Intellectual Property Office, the disclosure of which is incorporated herein in its entirety by reference.

BACKGROUND OF THE INVENTION

1. Field of the Invention

The present invention relates to a hydraulic circuit having a holding valve of an external pilot pressure operation type, which can prevent or reduce a push phenomenon of an actuator (e.g. hydraulic cylinder and so on) due to leakage of hydraulic fluid of a main control valve that controls the hydraulic fluid being fed to the actuator.

More particularly, the present invention relates to a hydraulic circuit having a holding valve of an external pilot pressure operation type, which can make a double check valve, which is installed to prevent an actuator from being pushed due to leakage of hydraulic fluid of a main control valve, be opened by an external signal pressure being supplied to shift the main control valve.

2. Description of the Prior Art

As illustrated in FIG. 1, a conventional hydraulic circuit includes a hydraulic pump p connected to and engine (not illustrated) and a pilot pump Pp; a hydraulic cylinder 1 connected to the hydraulic pump p to operate a working device such as a boom; a main control valve 2 installed in a flow path between the hydraulic pump p and the hydraulic cylinder 1 and shifted to control a start, a stop, and a direction change of the hydraulic cylinder 1 in response to a pilot signal pressure being supplied from the pilot pump Pp; and a joystick 11 supplying the pilot signal pressure from the pilot pump Pp to the main control valve 2 in accordance with an amount of user's manipulation thereof.

In the drawing, the reference numeral "R" denotes a relief valve installed in a flow path of the pilot pump Pp to protect a hydraulic system by draining a part of the hydraulic fluid to a hydraulic tank if overload that exceeds a pressure set in a pilot signal line occurs.

When the hydraulic cylinder 1 is stopped, hydraulic fluid leaks through a spool gap of the main control valve 2 (i.e. leakage of hydraulic fluid occurs through a gap of a spool installed in the main control valve 2 to be shifted in accordance with the pilot signal pressure being applied from an outside to the main control valve 2), and thus the hydraulic cylinder 1 is pushed to cause a safety accident against a user's intention to occur.

As illustrated in FIG. 2, another conventional hydraulic circuit having a holding valve of an internal pilot signal pressure operation type includes a hydraulic pump p and a pilot pump Pp respectively connected to an engine (not illustrated); a hydraulic cylinder 1 connected to the hydraulic pump p to operate a working device such as a boom; a main control valve 2 installed in a flow path between the hydraulic pump p and the hydraulic cylinder 1 and shifted to control a start, a stop, and a direction change of the hydraulic cylinder 1 in response to a pilot signal pressure being supplied from an outside; a joystick 11 supplying the pilot signal pressure from the pilot pump Pp to the main control valve 2 in accordance with an amount of user's manipulation thereof; and a double check valve 3 (composed of a check valve 4 and a valve spring 5 installed in the flow path, respectively, to serve as a holding valve) installed in a flow path between the main control valve 2 and the hydraulic cylinder 1 to be opened/closed by hydraulic pressure being supplied to the hydraulic cylinder 1, and preventing the hydraulic cylinder from being pushed due to leakage of hydraulic fluid through a spool gap of the main control valve 2.

At this time, a spool of the main control valve 2 is formed to be connected to a hydraulic tank when it is in a neutral state so as to prevent the check valve 4 from being opened due to a back pressure of the main control valve.

If a resilient force of the valve spring 5 is larger than a preset value, the check valve 4 is easily opened by the hydraulic pressure being supplied to the hydraulic cylinder 1, and thus a large amount of hydraulic fluid is discharged. Accordingly, if the back pressure of the main control valve 2 is increased, the check valve 4 is opened to cause a push phenomenon of the hydraulic cylinder 1 to occur.

By contrast, if the resilient force of the valve spring 5 is smaller than the preset value, the check valve 4 is opened after the hydraulic pressure being supplied to the hydraulic cylinder 1 reaches a predetermined pressure value. Accordingly, it is difficult to finely manipulate the working device to lower the manipulation, and this may cause an abrupt operation of the hydraulic cylinder 1.

Also, the check valve 4 repeats an instantaneous opening/closing operation under specified work conditions, and thus a shaking phenomenon occurs to cause severe vibration and noise.

SUMMARY OF THE INVENTION

Accordingly, the present invention has been made to solve the above-mentioned problems occurring in the prior art while advantages achieved by the prior art are maintained intact.

One object of the present invention is to provide a hydraulic circuit having a holding valve of an external pilot pressure operation type, which can make a double check valve, which is installed to prevent an actuator from being pushed due to leakage of hydraulic fluid of a main control valve, be opened by an external signal pressure being supplied to shift the main control valve.

In order to accomplish these objects, there is provided a hydraulic circuit having a holding valve of an external pilot pressure operation type, according to an embodiment of the present invention, which includes a hydraulic pump and a pilot pump respectively connected to an engine; a hydraulic cylinder connected to the hydraulic pump to expand and contract when hydraulic fluid is supplied thereto; a main control valve installed in a flow path between the hydraulic pump and the hydraulic cylinder and shifted to control a start, a stop, and a direction change of the hydraulic cylinder; a joystick outputting a pilot signal pressure from the pilot pump in accordance with an amount of user's manipulation thereof; a double check valve installed in a flow path between the main control valve and the hydraulic cylinder to be opened by the pilot signal pressure for shifting the main control valve, and preventing the hydraulic cylinder from being moved due to leakage of hydraulic fluid of the main control valve; and a select valve shifted to open the double check valve in response to the pilot signal pressure being supplied in accordance with the manipulation of the joystick.

The hydraulic circuit according to an embodiment of the present invention may further include a shuttle valve installed at a confluence point of pilot signal lines of the select valve and the main control valve to select a high pressure of signal pressures being supplied to the main control valve to expand or contract the hydraulic cylinder.

The double check valve and the select valve may be formed in a body.

The double check valve and the select valve may be separately formed and then assembled together.

A resilient force of a valve spring of the double check valve may be set to be larger than a force caused by a difference in pressure between both ends of the check valve in order to prevent the check valve from being opened when a back pressure is generated in the main control valve.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
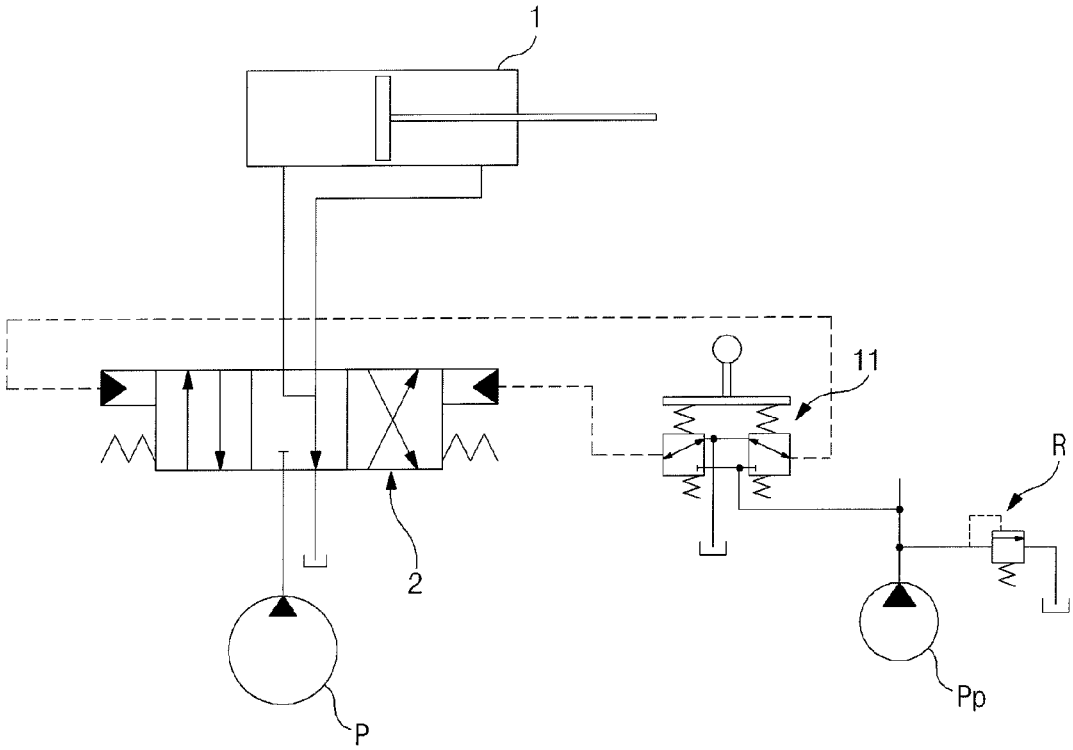
Fig. 1 Prior Art
FIG. 1 is a circuit diagram of a conventional hydraulic circuit.
Figure 2:
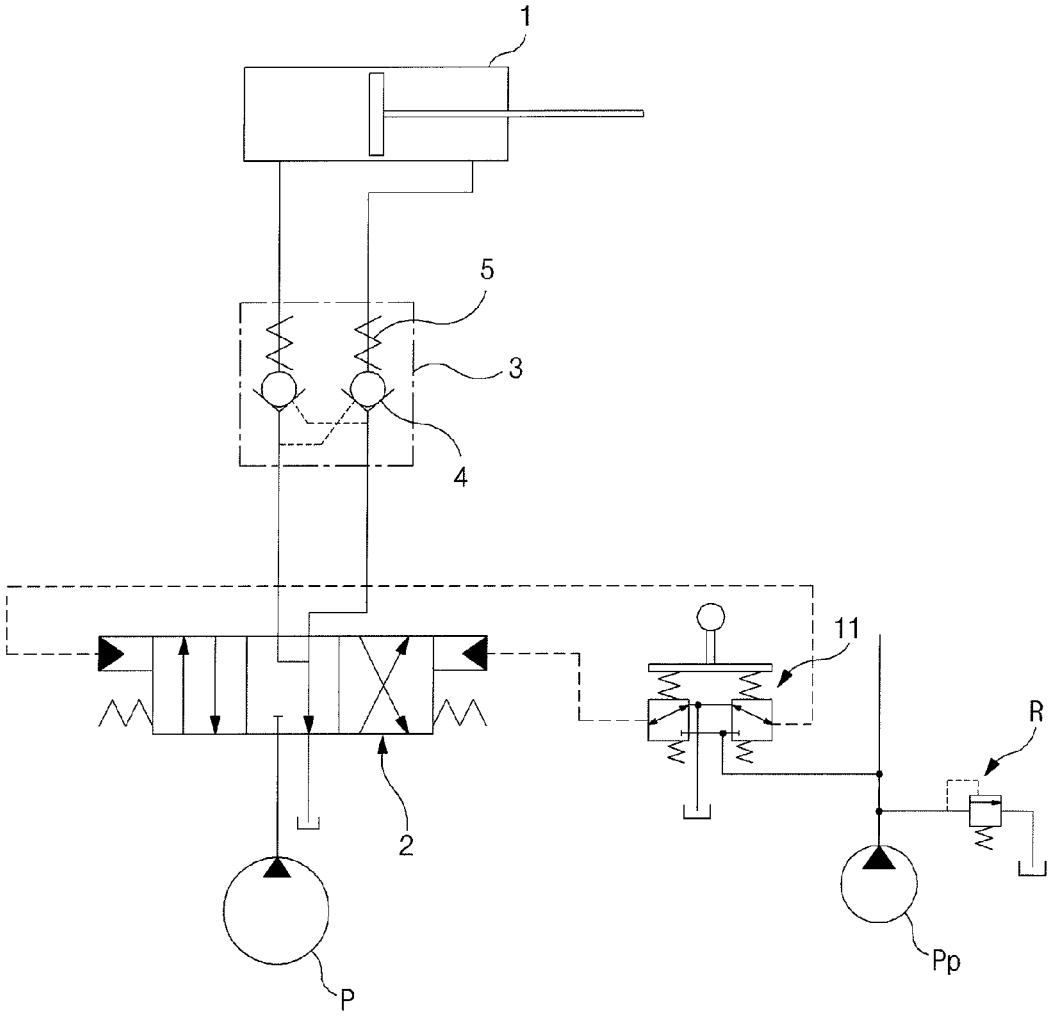
Fig. 2 Prior Art
FIG. 2 is a circuit diagram of another conventional hydraulic circuit having a holding valve of an internal pilot pressure operation type.
Figure 3:
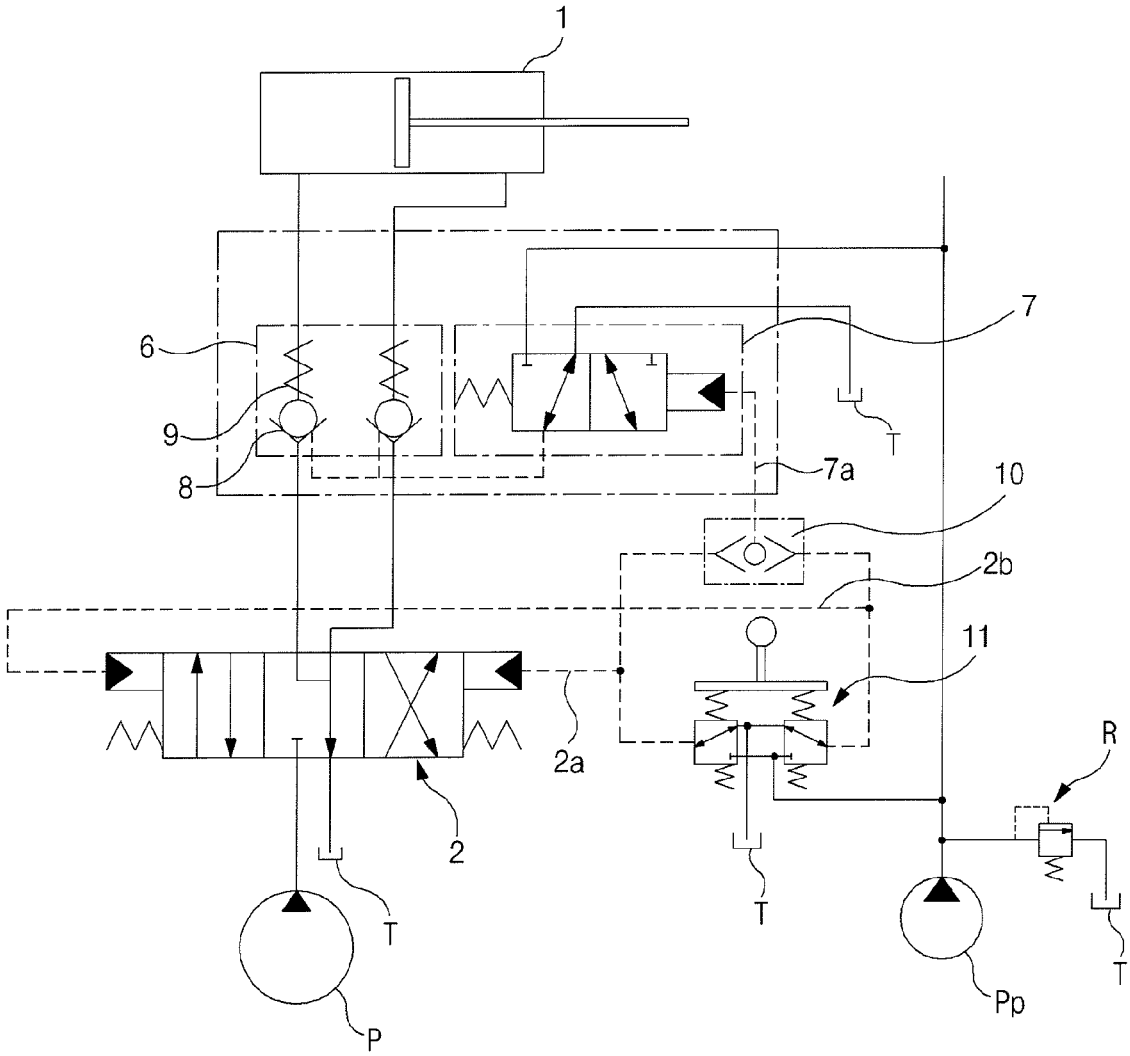
FIG. 3 is a circuit diagram of a hydraulic circuit having a holding valve of an external pilot pressure operation type according to an embodiment of the present invention.

As shown in FIG. 3, a hydraulic circuit having a holding valve of an external pilot pressure operation type according to an embodiment of the present invention includes a hydraulic pump P and a pilot pump Pp respectively connected to an engine (not illustrated); a hydraulic cylinder 1 connected to the hydraulic pump p to operate a working device such as a boom; a main control valve 2 installed in a flow path between the hydraulic pump p and the hydraulic cylinder 1 and shifted to control a start, a stop, and a direction change of the hydraulic cylinder 1 in response to a pilot signal pressure being supplied from the pilot pump Pp; a joystick 11 outputting a pilot signal pressure (i.e. secondary pressure) from the pilot pump Pp in accordance with an amount of user's manipulation thereof; a double check valve 6 (composed of a check valve 8 and a valve spring 9 to serve as a holding valve) installed in a flow path between the main control valve 2 and the hydraulic cylinder 1 to be opened by the pilot signal pressure for shifting the main control valve 2, and preventing the hydraulic cylinder 1 from being moved due to leakage of hydraulic fluid of the main control valve 2; and a select valve 7 shifted to open the check valve 8 of the double check valve 6 in response to the pilot signal pressure being supplied from the pilot pump Pp in accordance with the manipulation of the joystick 11.

The hydraulic circuit according to an embodiment of the present invention further includes a shuttle valve 10 installed at a confluence point of pilot signal lines 7*a*, 2*a* and 2*b* of the select valve 7 and the main control valve 2 to select a high pressure of signal pressures being supplied to the main control valve 2 to expand or contract the hydraulic cylinder 1.

The double check valve 6 and the select valve 7 are formed in a body.

The double check valve 6 and the select valve 7 are separately formed and then assembled together.

A resilient force of the valve spring 9 of the double check valve 6 is set to be larger than a force caused by a difference in pressure between both ends of the check valve 8 in order to prevent the check valve 8 from being opened when a back pressure is generated in the main control valve 2.

Hereinafter, the operation of the hydraulic circuit having a holding valve of an external pilot pressure operation type according to an embodiment of the present invention will be described with reference to the accompanying drawings.

A) In the case where the hydraulic cylinder is not operated (in this case, the main control valve 2 is kept in a neutral state)

As illustrated in FIG. 3, since the pilot signal line for opening the check valve 8 by a spool (in a state as illustrated in FIG. 3) of the select valve 7 is connected to the hydraulic tank T, the signal pressure being applied to the check valve 8 is lowered to an atmospheric pressure level.

At this time, since the resilient force of the valve spring 9 is set to be larger than the force caused by the difference in pressure between both ends of the check valve 8, the check valve 8 of the valve spring 9 is prevented from being opened by the valve spring 9 even if a high back pressure is formed in the main control valve 2.

B) In the case where the hydraulic cylinder is operated (in this case, the main control valve 2 is shifted by the pilot signal pressure)

As illustrated in FIG. 3, the pilot signal pressure from the pilot pump Pp is supplied to the shuttle valve 10 in accordance with the manipulation of the joystick 11, and simultaneously, the pilot signal pressure being supplied to the main control valve 2 through the pilot signal lines 2*a* and 2*b* is supplied to the shuttle valve 10.

Accordingly, a high pressure of signal pressures being supplied to the main control valve 2 so as to expand or contract the hydraulic cylinder 1 is selected by the shuttle valve 10. The signal pressure selected by the shuttle valve 10 is supplied to the select valve 7 through the pilot signal line 7*a* to shift an inner spool in a left direction as shown in the drawing.

Accordingly, when the hydraulic fluid from the hydraulic pump P is supplied to the hydraulic cylinder 1 via the main control valve 2 to expand or contract the hydraulic cylinder 1, the pilot signal pressure from the pilot pump Pp is simultaneously supplied to a pair of check valves 8 through the shifted select valve 7 to open the check valves 8.

At this time, the check valve 8 is opened by the pilot signal pressure being supplied from the pilot pump Pp to shift the main control valve 2 (in the conventional hydraulic circuit, the check valve is opened by the hydraulic pressure being supplied to the hydraulic cylinder 1). Accordingly, the manipulation of the working device is improved, and noise and vibration due to the repeated opening/closing operation of the check valve 8 is prevented.

As described above, the hydraulic circuit having a holding valve of an external pilot pressure operation type according to an embodiment of the present invention has the following advantages.

Since the double check valve, which is installed to prevent a push of the actuator due to leakage of the hydraulic fluid in the main control valve, is opened by the external pilot signal pressure being supplied to shift the main control valve, the manipulation of the working device is improved to heighten the work efficiency, and shaking phenomenon due to vibration and noise is prevented to heighten the reliability of the equipment.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic circuit having a holding valve of an external pilot pressure operation type, comprising:

a hydraulic pump and a pilot pump respectively connected to an engine;

a hydraulic cylinder connected to the hydraulic pump to expand and contract when hydraulic fluid is supplied thereto;

a main control valve installed in a flow path between the hydraulic pump and the hydraulic cylinder and shifted to control a start, a stop, and a direction change of the hydraulic cylinder;

a joystick outputting a pilot signal pressure from the pilot pump in accordance with an amount of user's manipulation thereof;

a double check valve installed in a flow path between the main control valve and the hydraulic cylinder to be opened by the pilot signal pressure for shifting the main control valve, and preventing the hydraulic cylinder from being moved due to leakage of hydraulic fluid of the main control valve; and a select valve shifted to open a check valve of the double check valve in response to the pilot signal pressure being supplied in accordance with the manipulation of the joystick, wherein a resilient force of a valve spring of the double check valve is set to be larger than a force caused by a difference in pressure between both ends of the check valve in order to prevent the check valve from being opened when a back pressure is generated in the main control valve.

2. The hydraulic circuit of claim 1, further comprising a shuttle valve installed at a confluence point of pilot signal lines of the select valve and the main control valve to select a high pressure of signal pressures being supplied to the main control valve to expand or contract the hydraulic cylinder.

3. The hydraulic circuit of claim 1, wherein the double check valve and the select valve are formed in a body.

4. The hydraulic circuit of claim 1, wherein the double check valve and the select valve are separately formed and then assembled together.

* * * * *